US007780100B2

(12) United States Patent
Helmig et al.

(10) Patent No.: US 7,780,100 B2
(45) Date of Patent: Aug. 24, 2010

(54) NOZZLE HEAD

(75) Inventors: Egbert Helmig, Ennigerloh (DE); Alwin Goering, Vreden (DE)

(73) Assignee: Hammelmann Maschinenfabrik GmbH, Oelde (DE)

( * ) Notice: Subject to any disclaimer, the term of this patent is extended or adjusted under 35 U.S.C. 154(b) by 891 days.

(21) Appl. No.: 11/600,830

(22) Filed: Nov. 17, 2006

(65) Prior Publication Data

US 2007/0165060 A1 Jul. 19, 2007

(30) Foreign Application Priority Data

Nov. 19, 2005 (DE) ..... 20 2004 018 108 U

(51) Int. Cl.
*B05B 7/04* (2006.01)
*B05B 7/14* (2006.01)
*B24C 5/04* (2006.01)

(52) U.S. Cl. ..... 239/434; 239/433; 239/DIG. 8; 451/102; 83/177

(58) Field of Classification Search ..... 239/398, 239/432–434.5, 596, 600, DIG. 8; 451/76, 451/102; 83/53, 177; 134/166 R, 167 R, 134/167 C, 171, 166 C, 198
See application file for complete search history.

(56) References Cited

U.S. PATENT DOCUMENTS

| | | | | |
|---|---|---|---|---|
| 2,577,465 | A | 12/1951 | Jones et al. | |
| 4,545,157 | A * | 10/1985 | Saurwein | 451/102 |
| 4,555,872 | A * | 12/1985 | Yie | 451/40 |
| 4,776,794 | A * | 10/1988 | Meller | 433/216 |
| 4,852,800 | A | 8/1989 | Murdock | |
| 4,995,201 | A | 2/1991 | von Borcke et al. | |
| 5,499,519 | A | 3/1996 | Brunier et al. | |
| 6,012,653 | A * | 1/2000 | Gunther et al. | 239/434 |
| 6,149,509 | A * | 11/2000 | Bruns et al. | 451/90 |
| 6,383,062 | B1 | 5/2002 | Jou | |
| 2004/0035958 | A1 | 2/2004 | Gromes, Sr. | |
| 2004/0063386 | A1 * | 4/2004 | Hopf et al. | 451/38 |
| 2005/0236430 | A1 | 10/2005 | Clark et al. | |

FOREIGN PATENT DOCUMENTS

| | | |
|---|---|---|
| DE | 38 21 817 A1 | 11/1989 |
| DE | 42 09 353 C2 | 9/1993 |
| DE | 29611512 U1 | 10/1996 |
| DE | 296 22 839 U1 | 6/1997 |
| DE | 19809367 A1 | 9/1999 |

(Continued)

OTHER PUBLICATIONS

German Search Report dated May 18, 2006 with partial English translation (Nine (9) pages).

(Continued)

*Primary Examiner*—Darren W Gorman
(74) *Attorney, Agent, or Firm*—Crowell & Moring LLP

(57) ABSTRACT

A nozzle head, having a feed line for a high-pressurized fluid, a channel for delivering an abrasive substance, with which the fluid can be loaded, as well as a discharge line, from which the fluid, loaded with abrasive substance, can issue, is designed such that the feed line and the channel run parallel or almost parallel to each other, and that the discharge line issues sideways from the nozzle head so as to run at an angle to the feed line.

14 Claims, 1 Drawing Sheet

FOREIGN PATENT DOCUMENTS

| | | | |
|---|---|---|---|
| DE | 19830397 | A1 | 1/2000 |
| DE | 200 10 854 | U1 | 9/2000 |
| DE | 10225304 | A1 | 12/2003 |
| EP | 0385561 | A1 | 2/1990 |
| EP | 0659523 | A1 | 6/1995 |
| GB | 2094679 | A | 9/1982 |
| WO | 97/19755 | | 6/1997 |

OTHER PUBLICATIONS

European search report dated Feb. 27, 2007.

* cited by examiner

NOZZLE HEAD

BACKGROUND AND SUMMARY OF THE INVENTION

This application claims the priority of German Application No. 20 2005 018 108.0, filed Nov. 19, 2005, the disclosure of which is expressly incorporated by reference herein.

The invention relates to a nozzle head and, in particular, to a nozzle head having a feed line for a high-pressurized fluid, a channel for delivering an abrasive substance, with which the fluid can be loaded, as well as a discharge line, from which the fluid, loaded with abrasive substance, can issue.

Such nozzle heads, through which is guided a high-pressurized fluid, for example water, with an abrasive substance as the additive, are used, for example, as cutting tools in order to cut all possible types of materials. In principle, these nozzle heads are also appropriate for surface treatment of workpieces, primarily for cleaning the surfaces or for roughening them, when it is necessary for a subsequent coating. However, the applicability of these nozzle heads is very limited, since their shape requires a relatively large amount of space so that, for example, the treatment of the inner surfaces of hollow bodies with small inside dimensions is not possible.

In the prior art nozzle heads, the abrasive material is admixed with the fluid from the side. After mixing with the material, the fluid issues from the nozzle head in the subsequent axial conveyance to the feed line. An inside surface, which runs parallel to the feed line and belongs to a hollow body, is almost impossible to treat or can be treated only unsatisfactorily with the prior art nozzle heads, since the issuing fluid impinges on this surface only at a relatively acute angle.

Therefore, the invention is based on the problem of further developing a nozzle head of the above-mentioned type in such a manner that its applicability is improved.

This problem is solved with a nozzle head having a feed line for a high-pressurized fluid, a channel for delivering an abrasive substance, with which the fluid can be loaded, as well as a discharge line, from which the fluid, loaded with abrasive substance, can issue. The feed line and the channel run parallel or almost parallel to each other. The discharge line issues sideways from the nozzle head so as to run at an angle to the feed line.

This structural design of the nozzle head enables an extremely compact construction, which allows the nozzle head to be introduced into hollow bodies that exhibit a relatively small inside diameter so that the inside surface of the hollow body may be treated easily and effectively.

Such a treatment constitutes, for example, the roughening of the surface in order to subsequently coat the surface, with the result that the roughening causes the coating to bind more intensively with the carrier surface.

An advantageous further development of the invention provides that the feed line for the high-pressurized fluid passes over, starting from an axial orientation, into a discharge line, which runs at right angles or approximately right angles. In the latter case, the angle may range from 60 deg. to 120 deg. The discharge line exhibits a mixing chamber, in which the abrasive material is admixed. That is, the channel conveying the abrasive substance empties into this mixing chamber.

In another aspect of the invention, the nozzle head is constructed in two parts, whereby the two joint faces, which lie side by side, extend in the axial direction of the feed line and/or the channel. Therefore, one component includes the feed line for the fluid; and the other component includes the channel, whereas the discharge line extends diagonally thereto in both components. The division of the nozzle head makes possible a very simple and inexpensive production, whereby the two components are preferably screwed together.

To treat the entire inside surface of a hollow body, it is expedient to rotate the hollow body around the nozzle head, while simultaneously moving the nozzle head axially, preferably back and forth. Moreover, owing to the lateral design, the fluid, loaded with the abrasive material, impinges perpendicularly on the surface to be treated, with the result that the efficiency is higher, since the particles of the abrasive substance are not deflected.

In addition, there is the possibility of moving the nozzle head axially over a relatively long distance, with the result that the nozzle head plunges deeper into the hollow body, thus, of course, also improving the applicability.

The invention makes it possible to treat workpieces in the aforementioned sense, which had been possible up to now only with a lot of equipment and time. In fact, now even those workpieces can be treated that to date could not be processed, at least not in this way.

Other advantageous designs of the invention are described and claimed herein.

Other objects, advantages and novel features of the present invention will become apparent from the following detailed description of the invention when considered in conjunction with the accompanying drawings.

DETAILED DESCRIPTION OF THE DRAWINGS

Figure 1:
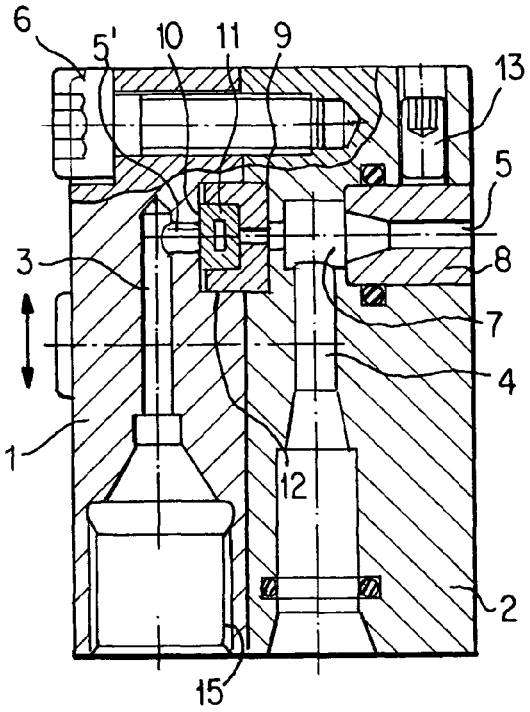
FIG. 1 is a longitudinal view of the nozzle head according to the invention.
Figure 2:
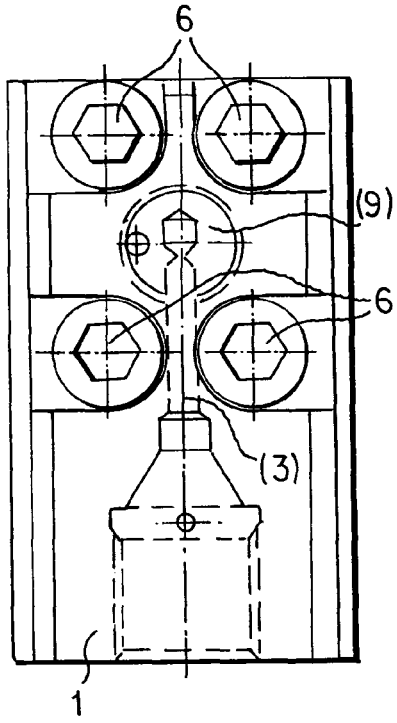
FIG. 2 is a front view of the nozzle head according to the invention.

The figures depict a nozzle head, which consists of two parts and, in particular, a first component 1 and a second component 2.

The first component 1 contains a feed line 3 for a high-pressurized fluid, which can be delivered from a unit. The feed line is constructed as a blind hole; and a branch 5' branches off sideways from the feed line in the area of the base.

The second component 2 is provided with a channel 4, through which an abrasive substance is fed to the fluid stream. This channel 4 runs parallel or almost parallel (<30 deg.) to the feed line 3. Therefore, the feed ports are arranged on the adjacent face sides of the first and second component 1, 2.

Both components 1, 2 rest side by side against the joint faces 15, which are oriented paraxially to the feed line 3 or to the channel 4, and are connected rigidly together by way of screws 6 or the like.

The branch 5' empties into a recess 12, which is provided both in the first component 1 as well as in the second component 2 and is mounted in the one nozzle body 9, which accommodates a nozzle plate 10 with an enclosed high pressure nozzle 11. The nozzle plate 10 rests against the base of the recess 12, assigned to the first component 1; and the nozzle body 9 rests against the base of the recess 12, assigned to the second component 2. Both parts form a sealing surface in that the nozzle body 9 and/or the nozzle plate 10 is/are rigidly clamped with screws 6.

The nozzle ports, which are provided in the continuation of the branch 5' and which belong to the nozzle body 9, the nozzle plate 10 and the high pressure nozzle 11, empty into a mixing chamber 7 in the second component 2, to which the abrasive material is delivered in the sense of an injector nozzle by way of the channel 4.

Figure 3:
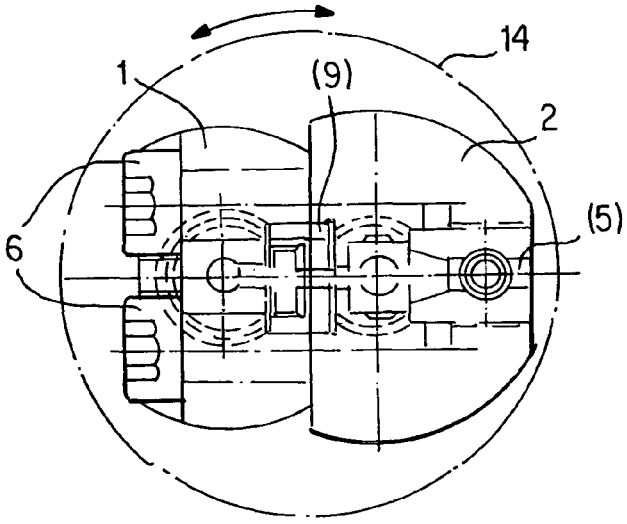
FIG. 3 is a top view of the nozzle head according to the invention.

This mixing chamber 7 passes over into a discharge line 5, from which the mixture of fluid and abrasive substance for treating the surface, for example the inside surface of a hollow body 14, as indicated by the dashed-dotted line in FIG. 3, issues sideways from the nozzle head and/or the second component 2, so as to run at an angle to the feed line 3.

The discharge line 5 is inserted in an insert 8, which is held rigidly in the second component 2 with a clamping screw 13.

According to the double arrow in FIG. 1, the nozzle head can be moved axially back and forth in operation, whereas the workpiece, that is to say the hollow body 14, can be rotated about the nozzle head. As an alternative to the axial movement of the nozzle head, the workpiece can also be moved axially back and forth. Similarly, in the case of a standing workpiece, a rotational movement of the nozzle head is also contemplated. In any case, the axial and rotational movement enables a uniform treatment of the entire surface of the workpiece.

Table of Reference Numerals

| | |
|---|---|
| 1 | first component |
| 2 | second component |
| 3 | feed line |
| 4 | channel |
| 5 | discharge line |
| 5' | branch |
| 6 | screw |
| 7 | mixing chamber |
| 8 | insert |
| 9 | nozzle body |
| 10 | nozzle plate |
| 11 | high pressure nozzle |
| 12 | recess |
| 13 | clamping screw |
| 14 | hollow body |
| 15 | joint face |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A nozzle head, comprising:

a feed line for a high-pressurized fluid;

a channel for delivering an abrasive substance for loading with the fluid; and a discharge line from which the fluid, loaded with the abrasive substance, is discharged;

wherein the feed line and the channel run at least one of parallel and almost parallel to one another, the discharge line extending at an angle to the feed line and issuing sideways from the nozzle head;

wherein the nozzle head is made of two components;

wherein adjacent joint faces of the two components are arranged running parallel to the feed line; and wherein the feed line is designed as a blind hole, to which a branch is attached to a side area of the blind hole, the branch passing over into passage openings of a nozzle plate, a high pressure nozzle as well as a nozzle body, all of which are operatively connected to the discharge line.

2. The nozzle head according to claim 1, wherein the channel extends at an angle of less than or equal to 30° to the feed line.

3. The nozzle head according to claim 1, wherein the discharge line extends at a right angle or almost a right angle to the feed line.

4. The nozzle head according to claim 1, wherein the two components are screwed together.

5. The nozzle head according to claim 1, wherein the nozzle body is accommodated in the recesses of the first and the second component, whereby the recesses are arranged in the area of the joint faces, which face each other and which belong to the first and second component.

6. The nozzle head according to claim 5, wherein the two components are screwed together.

7. The nozzle head according to claim 5, wherein the nozzle body rests under pressure against a base of one of said recesses and accommodates the nozzle plate, which is braced against a side of another of said recesses and which encloses the high pressure nozzle.

8. The nozzle head according to claim 1, wherein the nozzle body rests under pressure against a base of a recess and accommodates the nozzle plate, which is braced against a side of another recess and which encloses the high pressure nozzle.

9. The nozzle head according to claim 1, wherein contact surfaces of the nozzle body and the nozzle plate form a sealing surface.

10. The nozzle head according to claim 1, wherein the channel empties in a mixing chamber, which is connected, on the one hand, to the branch and is connected, on the other hand, to the discharge line.

11. The nozzle head according to claim 10, wherein the mixing chamber and/or the channel acts/act in interaction with the fluid flow, guided through the branch, in the sense of a venturi nozzle.

12. The nozzle head according to claim 10, wherein the discharge line is disposed in an insert held in place by way of a clamping screw.

13. The nozzle head according to claim 1, wherein the discharge line is disposed in an insert held in place by way of a clamping screw.

14. The nozzle head according to claim 1, wherein the nozzle head is mounted so as to move axially back and forth and/or rotate.

* * * * *